US011425967B2

(12) United States Patent
Hsien-Teng

(10) Patent No.: US 11,425,967 B2
(45) Date of Patent: Aug. 30, 2022

(54) METHOD FOR THE PRODUCTION OF A SHOE, ESPECIALLY OF A SPORTS SHOE

(71) Applicant: PUMA SE, Herzogenaurach (DE)

(72) Inventor: Liu Hsien-Teng, Taichung (TW)

(73) Assignee: PUMA SE, Herzogenaurach (DE)

( * ) Notice: Subject to any disclaimer, the term of this patent is extended or adjusted under 35 U.S.C. 154(b) by 39 days.

(21) Appl. No.: 16/766,662

(22) PCT Filed: Nov. 25, 2017

(86) PCT No.: PCT/EP2017/080434
§ 371 (c)(1),
(2) Date: May 22, 2020

(87) PCT Pub. No.: WO2019/101339
PCT Pub. Date: May 31, 2019

(65) Prior Publication Data

US 2020/0359748 A1 Nov. 19, 2020

(51) Int. Cl.
*A43D 25/06* (2006.01)
*A43B 9/12* (2006.01)
(Continued)

(52) U.S. Cl.
CPC ..... *A43D 25/06* (2013.01); *A43B 9/12* (2013.01); *A43D 25/07* (2013.01); *A43D 25/20* (2013.01); *A43D 95/10* (2013.01)

(58) Field of Classification Search
CPC ..... A43D 25/06; A43D 95/10; A43D 25/20; A43D 25/07; A43B 9/12
See application file for complete search history.

(56) References Cited

U.S. PATENT DOCUMENTS 1,620,344 A 3/1927 Hahn
6,497,786 B1 * 12/2002 Kilgore ..... B29C 65/7867 156/379.8
(Continued)

FOREIGN PATENT DOCUMENTS

CN 103153110 A 6/2013
CN 107455847 A * 12/2017
(Continued)

OTHER PUBLICATIONS

First Office Action from corresponding Chinese Patent Application No. 201780097040.4, dated May 6, 2021, (13 pages) (English translation included).
(Continued)

*Primary Examiner* — Sharon M Prange
*Assistant Examiner* — Erick I Lopez
(74) *Attorney, Agent, or Firm* — Quarles & Brady LLP

(57) ABSTRACT

The invention relates to a method for the production of a shoe (1), especially of a sports shoe. To provide an effective and cost-efficient method for the shoe production, the invention comprises the steps: a) Production of a shoe upper (2) and of a shoe sole (3); b) Joining of the shoe upper (2) and the shoe sole (3) and inserting the joined shoe upper (2) and the shoe sole (3) into a flexible container element (4) which can be closed in an air-tight manner; c) Air-tight closing of the container element (4) and evacuating of the container element (4), so that the container element (4) presses together the joined shoe upper (2) and the shoe sole (3) within the container element (4); d) Connecting the shoe upper (2) and the shoe sole (3) within the container element (4) with another; e) Venting of the container element (4) and taking out the connected shoe upper (2) and shoe sole (3).

16 Claims, 3 Drawing Sheets

Figure 1:
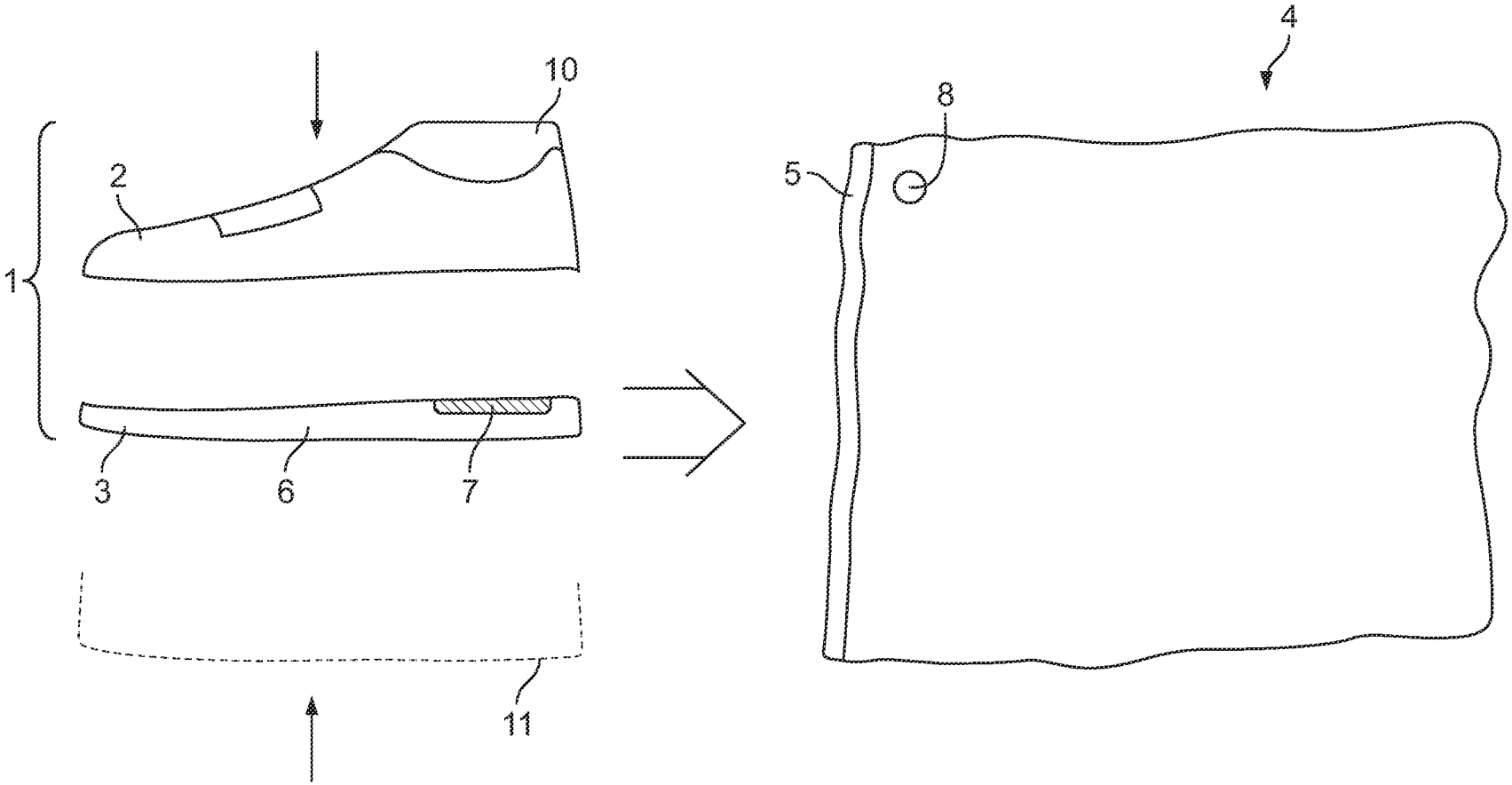

(51) Int. Cl.

| | |
|---|---|
| ***A43D 25/07*** | (2006.01) |
| ***A43D 25/20*** | (2006.01) |
| ***A43D 95/10*** | (2006.01) |

(56) References Cited

U.S. PATENT DOCUMENTS

| | | | | |
|---|---|---|---|---|
| 2004/0205980 | A1 | 10/2004 | Issler | |
| 2005/0051486 | A1* | 3/2005 | Zuk | A61M 1/3633 210/645 |
| 2017/0129200 | A1 | 5/2017 | Adami et al. | |
| 2018/0125159 | A1 | 5/2018 | Adami et al. | |
| 2019/0008237 | A1* | 1/2019 | Wang | A43D 25/20 |

FOREIGN PATENT DOCUMENTS

| | | | |
|---|---|---|---|
| JP | 62-9905 | U | 1/1987 |
| WO | 1999/24498 | A2 | 5/1999 |
| WO | 2017083550 | A1 | 5/2017 |

OTHER PUBLICATIONS

Search report from corresponding Chinese Patent Application No. 201780097040.4 dated Apr. 26, 2021 (2 pages).

International Search Report and Written Opinion of International Application No. PCT/EP2017/080434, dated Jul. 16, 2018, 10 pages.

International Preliminary Report on Patentability (Form IPEA/409) of International Application No. PCT/EP2017/080434, dated Jan. 7, 2020, 24 pages.

* cited by examiner

METHOD FOR THE PRODUCTION OF A SHOE, ESPECIALLY OF A SPORTS SHOE

This application is a U.S. National Stage application, filed pursuant to 35 U.S.C. § 371, of International Application No. PCT/EP2017/080434, filed on Nov. 25, 2017, which is incorporated by reference herein in its entirety.

The invention relates to a method for the production of a shoe, especially of a sports shoe.

Normally, for the production of shoes tools are required which causes significant investment costs so that the production of the shoe is respectively expensive. The shoe upper at the one side and the sole at the other side must be brought into tight contact with another before the connection process takes place. This must be done at a due geometrical adjustment between the shoe upper and the sole which causes corresponding costs for the tool system.

It is an object of the present invention to provide a method for the production of shoes which allows a significant reduction specifically of the tool costs. In spite of this it is aimed for a good connection between the shoe upper and the sole.

The solution of this object according to the invention is characterized in that the method comprises the steps:

a) Production of a shoe upper and of a shoe sole;

b) Joining of the shoe upper and the shoe sole and inserting the joined shoe upper and the shoe sole into a flexible container element which can be closed in an air-tight manner;

c) Air-tight closing of the container element and evacuating of the container element, so that the container element presses together the joined shoe upper and the shoe sole within the container element;

d) Connecting the shoe upper and the shoe sole within the container element with another;

e) Venting of the container element and taking out the connected shoe upper and shoe sole.

The container element is preferably a bag of a resilient material. It can be specifically a plastic bag, preferably made of polyethylene.

The container element can be provided with a closure element for opening and closing the container element. This closure element can be an air-tight zipper.

The shoe sole can consist of several parts, wherein the parts are connected with another before carrying out above step b). Here, an adhesive can be provided between the parts.

The evacuation according to above step c) can take place by connecting the container element with an evacuation pump. The connection of the container element with the evacuation pump can be carried out via a valve element or pipe socket which is provided at the container element.

The connection of the shoe upper and the shoe sole according to above step d) is preferably carried out by applying a microwaves radiation to the contact zone between the shoe upper and the shoe sole. The application of the microwaves radiation is thereby preferably carried out between 15 and 60 seconds, specifically between 20 and 40 seconds.

The connection of the shoe upper and the shoe sole according to above step d) can be carried out by melting of material of the shoe upper and/or shoe sole in the contact zone between shoe upper and shoe sole and letting the molten material fuse with adjacent material of the shoe upper and/or shoe sole. So, a welding process is carried out.

Alternatively or additively it can be taken in consideration that prior to the joining of the shoe upper and the shoe sole an adhesive is provided between the shoe upper and the shoe sole. The adhesive can thereby be a hot-melt adhesive which is at least partially melted during above step d).

Between above step d) and step e) the connected shoe upper and shoe sole can be cooled, preferably between 30 and 120 seconds. Cooling can take place by placing the container with the shoe at ambient conditions for a certain time.

Finally, it is beneficial for the due shaping of the shoe that a shoe last is arranged within the shoe upper at least during above steps b) to e).

That is, a vacuum bag is used for pressing the shoe upper and the shoe sole against another so that the parts get in close contact with another and can then be connected by a respective connection process.

Different sole parts (midsole, outer sole, etc.) can be pre-connected with another (for example by means of an adhesive) before the sole is joined with the shoe upper and both elements are put into the mentioned bag.

Beneficially, by using the mentioned process an extensive cleaning process of the components before bringing them into the bag is redundant. Also a roughening process of the components to be connected is normally not necessary.

If a connection of the shoe upper and the sole is carried out by means of a microwave radiation it can be beneficial to supply the surfaces which have to be connected with an adhesive. This becomes beneficially redundant if the two materials which have to be connected are made of the same material. Insofar, preferably thermoplastic polyurethane (TPU) is used.

A specifically obtained advantage of the proposed solution is that the combination of the evacuated container element (bag) with microwave radiation for the connection of the shoe upper and the shoe sole delivers a quick and secure connection between the components at low tool and production costs.

To ensure that the shoe upper and the sole (before being connected, e.g. by means of the microwave radiation) remain in due adjustment between one another it can be helpful to use clips or tapes to provisionally connect the mentioned parts. Another possibility for doing so is the use of negatively shaped holding parts (e.g. deep-drawn parts) which hold the components together and which are also inserted into the container element.

At the evacuation of the container element the parts (shoe upper and sole) are pressed together due to the vacuum in the container element. By the subsequent connection process (e. g. by means of the microwave radiation) the components are firmly connected with another.

The use of the described methods has the significant advantage of very low tool costs, i. e. the required tool is basically restricted to the vacuum container and a vacuum pump.

Furthermore, the handling of the process is very easy and can be carried out by low educated staff.

An equal contact pressure is obtained in all relevant regions between the shoe upper and the sole.

Also, soles with an undercut in the sole (e. g. soccer soles with attached heel caps) can easily be pressed together with the shoe upper.

In the drawings an embodiment of the invention is shown.

Figure 2:
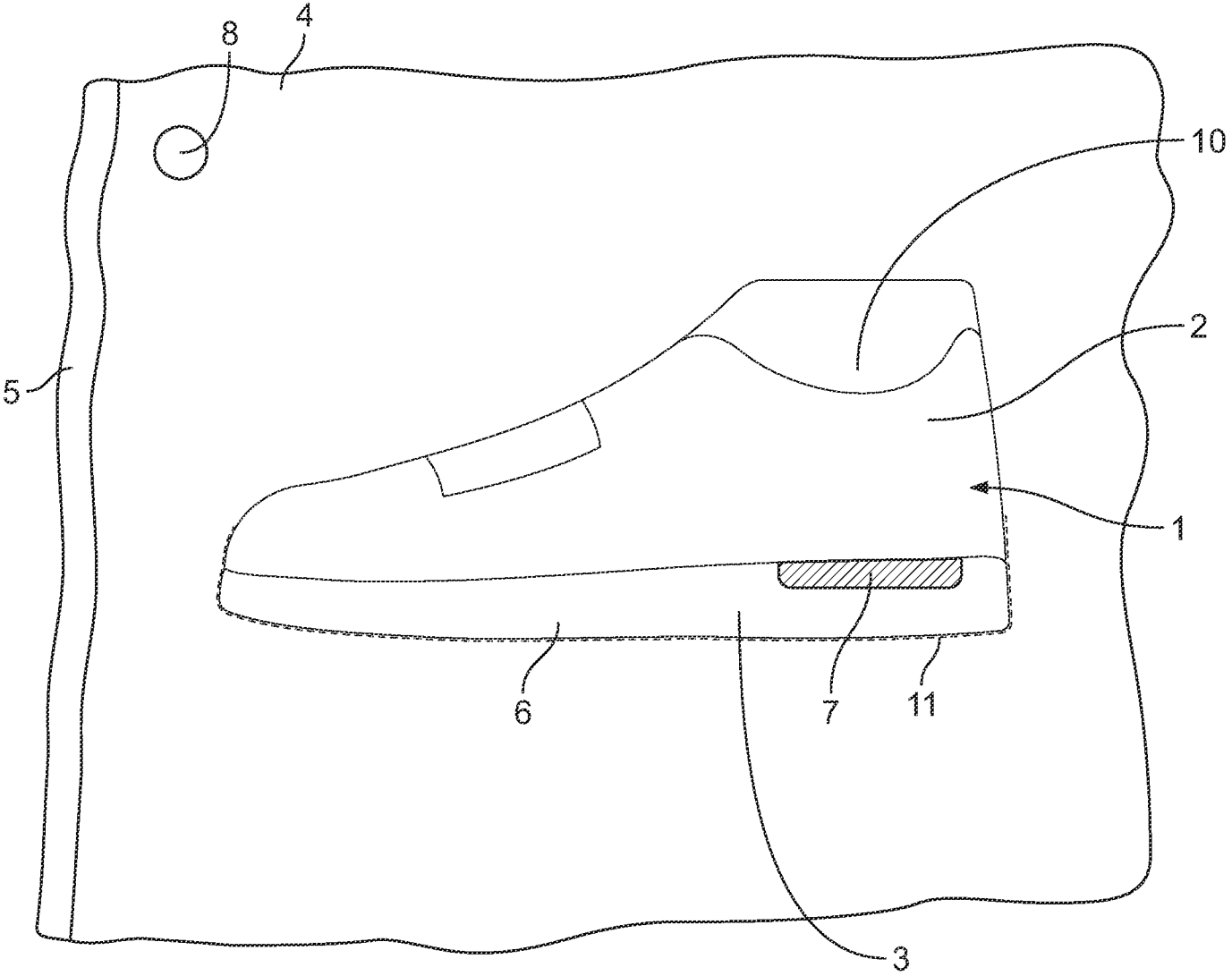
Figure 3:
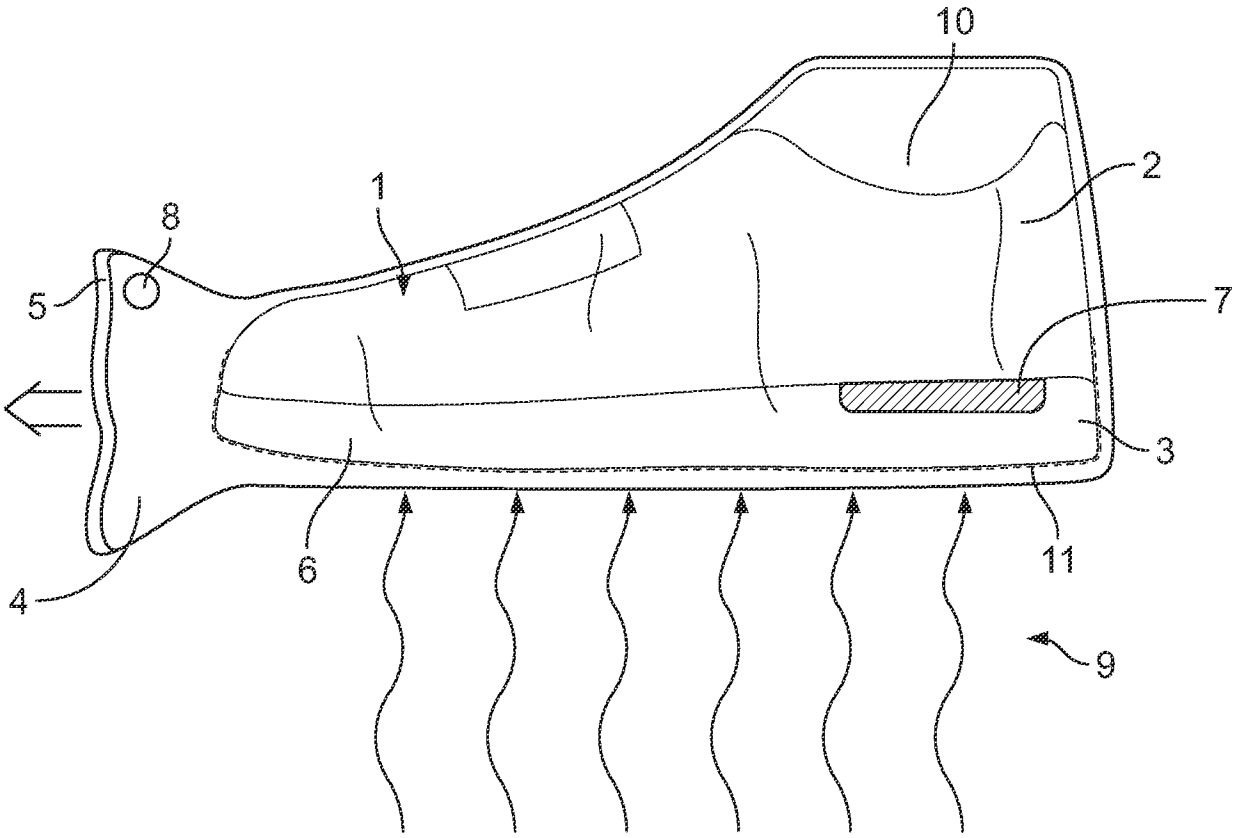

FIG. 1 shows a shoe upper and a shoe sole, still being separated, as well as a resilient bag, FIG. 2 shows the joined shoe upper and shoe sole being inserted into the bag and FIG. 3 shows the evacuated bag during the connection process of the shoe upper and the shoe sole.

In FIG. 1 a shoe upper 2 and a sole 3 are shown in the left part of the figure, wherein the two components 2, 3 are still separated from another. Both components 2, 3 are separately produced by respective processes and are brought together at the beginning of the connection process as described below.

To maintain the desired shape of the shoe upper 2 a shoe last 10 is inserted into the shoe upper 2.

Also, the sole 3 consists presently of a first part 6 and a second part 7. More specifically, the first part 6 is a base body of the sole while the second part 7 is an insert which is placed into a respective recession within the part 6. This is shown in FIG. 1 only in a schematic manner. Of course it is possible that different shaped parts or inserts are used together with a base part of the sole to form the whole sole 3. A part of the sole can consist for example of a rubber material. It can for example be connected with the base part of the sole by means of a hot-melt powder coating process, by use of a hot-melt film or by a cement coating. The parts can be foamed or non-foamed.

Specifically a midsole element can be combined with a number of rubber elements (which form the outer sole later on). The whole arrangement can be placed in a (deep-drawn) holding part 11, which holds the parts together during the subsequent connection process with the shoe upper.

With respect to the different parts, which form the sole, pre-molded parts made of expanded TPU, EVA, polyurethane or other materials can be taken in consideration. Also, loose beads (especially made of expanded TPU) can be considered which are place in a sole element and which are connected with the same by suitable connection methods. Here, the mentioned holding part 11 is specifically suitable.

The shoe upper 2 and the sole 3 are brought into contact as indicated by the arrows in FIG. 1.

Then, the (still loosely) combined or joined parts 2, 3 are put into a container element 4 (see big arrow in FIG. 1) which is a plastic bag in the present case, consisting of polyethylene (which material is not influenced by a microwave radiation).

The container element 4 has a closure element 5 at one open end for an air-tight closure of the container element 4 after the components 2, 3 have been put into the element 4. After this is done the closure element 5 is closed and thus the components 2, 3 are air-tight contained within the container element 4.

This situation is depicted in FIG. 2. Here, the shoe upper 2 and the sole 3 are geometrically adjusted to another and put into the container element 4 which is closed now by the closure element 5. The shoe upper 2 is supported by the shoe last 10.

Now, an evacuation process is carried out as depicted in FIG. 3. The container element 4 has a valve element or pipe socket 9 which is suitable for the fluidic connection with a vacuum pump (not depicted). It is indicated in FIG. 3 that now the container element 4 consisting of a resilient material presses together the shoe upper 2 and the sole 3 due to the vacuum within the container element 4.

Now, a microwave radiation—indicated by a couple of arrows in FIG. 3—is applied to the contact region between the shoe upper 2 and the sole 3 to firmly connect both components. Thereby, material in the contact zone between shoe upper 2 and sole 3 can be melted so that a deep connection is created between the components.

So, the finished shoe 1 is created. After a certain time of cooling the closure element 5 is opened so that air can be vented into the inner of the container element 4. Then, the shoe 1 can be taken out of the container element 4.

The bag (container element) 4 can be re-used so that specifically low costs for the production process are obtained.

REFERENCE NUMERALS

1 Shoe
2 Shoe upper
3 Shoe sole
4 Container element
5 Closure element
6 Part of the shoe sole
7 Part of the shoe sole
8 Valve element/pipe socket
9 Microwaves radiation
10 Shoe last
11 Holding part

The invention claimed is:

1. A method for producing a shoe, comprising the steps of:

providing a shoe upper and a shoe sole;

joining the shoe upper and the shoe sole and inserting the joined shoe upper and the shoe sole into a flexible container element, which can be closed in an air-tight manner, wherein a shoe last is arranged within the shoe upper, and wherein the shoe upper and the shoe sole are placed in a negatively shaped holding part for due adjustment between the shoe upper and the shoe sole, and to hold the shoe upper and the shoe sole together, the negatively shaped holding part also being inserted into the flexible container element;

closing and evacuating the flexible container element, so that the flexible container element presses together the joined shoe upper and the shoe sole within the flexible container element;

connecting the shoe upper and the shoe sole within the flexible container element by applying a microwave radiation to a contact zone between the shoe upper and the shoe sole, wherein the microwave radiation is applied from outside the flexible container element; and venting the flexible container element and taking the connected shoe upper and shoe sole out of the flexible container element.

2. The method of claim 1, characterized in that the flexible container element is a bag of a resilient material.

3. The method of claim 1, characterized in that the flexible container element is a plastic bag made of polyethylene.

4. The method of claim 1, characterized in that the flexible container element is provided with a closure element for opening and closing the flexible container element.

5. The method of claim 4, characterized in that the closure element is an air-tight zipper.

6. The method of claim 1, characterized in that the shoe sole consists of a base body and an insert, wherein the base body and the insert are connected with one another before the shoe upper and shoe sole are joined.

7. The method of claim 6, characterized in that an adhesive is provided between the base body and the insert.

8. The method of claim 1, characterized in that the flexible container element is evacuated with an evacuation pump.

9. The method of claim 8, characterized in that the connecting of the flexible container element with the evacuation pump is carried out via a valve element or pipe socket, which is provided at the flexible container element.

10. The method of claim 1, characterized in that the application of the microwave radiation is carried out between 15 and 60 seconds.

11. The method of claim 1, characterized in that the connecting of the shoe upper and the shoe sole is carried out by melting the material of the shoe upper and/or the shoe sole in a contact zone between the shoe upper and the shoe sole and letting the molten material fuse with adjacent material of the shoe upper and/or the shoe sole.

12. The method of claim 1, characterized in that, prior to the joining of the shoe upper and the shoe sole, an adhesive is provided between the shoe upper and the shoe sole.

13. The method of claim 12, characterized in that the adhesive is a hot-melt adhesive.

14. The method of claim 1, characterized in that the connected shoe upper and shoe sole is cooled between 30 and 120 seconds.

15. The method of claim 1, characterized in that the negatively shaped holding part is a deep drawn part.

16. The method of claim 1, characterized in that the microwave radiation is emitted in a direction moving from the shoe sole toward the shoe upper.

* * * * *